US010443931B2

(12) United States Patent
Demski et al.

(10) Patent No.: US 10,443,931 B2
(45) Date of Patent: Oct. 15, 2019

(54) METHOD AND DEVICE FOR THE CRYOGENIC DECOMPOSITION OF AIR

(71) Applicant: LINDE AKTIENGESELLSCHAFT, Munich (DE)

(72) Inventors: Georg Demski, Augsburg (DE); Alexander Alekseev, Wolfratshausen (DE); Thomas Rathbone, Kirkcaldy (GB); Dimitri Goloubev, Munich (DE); Ayhan Yayli, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1204 days.

(21) Appl. No.: 14/345,840

(22) PCT Filed: Sep. 20, 2012

(86) PCT No.: PCT/EP2012/003944

§ 371 (c)(1),
(2) Date: Mar. 19, 2014

(87) PCT Pub. No.: WO2013/041229

PCT Pub. Date: Mar. 28, 2013

(65) Prior Publication Data

US 2014/0223959 A1 Aug. 14, 2014

(30) Foreign Application Priority Data

Sep. 20, 2011 (DE) ..... 10 2011 113 668
Sep. 20, 2011 (DE) ..... 10 2011 113 671
(Continued)

(51) Int. Cl.
*F25J 3/00* (2006.01)
*F25J 3/04* (2006.01)

(52) U.S. Cl.
CPC ..... *F25J 3/04454* (2013.01); *F25J 3/04* (2013.01); *F25J 3/0409* (2013.01); *F25J 3/0486* (2013.01);
(Continued)

(58) Field of Classification Search
CPC ..... F25J 3/04878; F25J 3/04; F25J 3/0486; F25J 3/04872; F25J 3/04884;
(Continued)

(56) References Cited

U.S. PATENT DOCUMENTS 5,469,710 A * 11/1995 Howard ..... F25J 3/0409 62/646
5,485,729 A * 1/1996 Higginbotham ..... F25J 3/0409 62/646
(Continued)

FOREIGN PATENT DOCUMENTS

DE 10009977 A1 9/2001
EP 1227288 A1 7/2002
(Continued)

OTHER PUBLICATIONS

International Search Report for PCT/EP2012/003944 dated Dec. 5, 2012.
(Continued)

*Primary Examiner* — Keith M Raymond
(74) *Attorney, Agent, or Firm* — Millen White Zelano & Branigan, PC

(57) ABSTRACT

The method and the device arc used for the cryogenic decomposition of air in a distillation column system for separating nitrogen and oxygen, said system having a first high-pressure column (23), a low-pressure column (25, 26), and three condenser-evaporators, namely a high-pressure column head condenser (27), a low-pressure column bottom evaporator (28), and an auxiliary condenser (29; 228).

30 Claims, 9 Drawing Sheets

(30) Foreign Application Priority Data

Oct. 25, 2011 (EP) ..... 11008534
May 31, 2012 (EP) ..... 12004193

(52) U.S. Cl.
CPC ..... *F25J 3/04103* (2013.01); *F25J 3/04157* (2013.01); *F25J 3/04169* (2013.01); *F25J 3/04181* (2013.01); *F25J 3/04206* (2013.01); *F25J 3/04212* (2013.01); *F25J 3/04218* (2013.01); *F25J 3/04303* (2013.01); *F25J 3/04309* (2013.01); *F25J 3/04448* (2013.01); *F25J 3/04872* (2013.01); *F25J 3/04878* (2013.01); *F25J 3/04884* (2013.01); *F25J 2200/10* (2013.01); *F25J 2200/54* (2013.01); *F25J 2205/02* (2013.01); *F25J 2205/32* (2013.01); *F25J 2205/34* (2013.01); *F25J 2205/62* (2013.01); *F25J 2215/54* (2013.01); *F25J 2235/42* (2013.01); *F25J 2235/50* (2013.01); *F25J 2235/52* (2013.01); *F25J 2245/50* (2013.01); *F25J 2250/04* (2013.01); *F25J 2250/10* (2013.01); *F25J 2250/40* (2013.01); *F25J 2250/50* (2013.01)

(58) Field of Classification Search
CPC .. F25J 3/04103; F25J 3/04157; F25J 3/04169; F25J 3/04181; F25J 3/04206; F25J 3/04212; F25J 3/04303; F25J 3/04309; F25J 3/04454; F25J 3/0409; F25J 3/04218; F25J 3/04448; F25J 2200/08; F25J 2200/50; F25J 2200/52; F25J 2200/90; F25J 2250/02; F25J 2250/04; F25J 3/0489; F25J 3/04424
See application file for complete search history.

(56) References Cited

U.S. PATENT DOCUMENTS

| | | | | | |
|---|---|---|---|---|---|
| 5,669,237 | A * | 9/1997 | Voit | F25J 3/04387 | 62/646 |
| 5,682,762 | A * | 11/1997 | Agrawal | F25J 3/04321 | 62/643 |
| 5,730,003 | A * | 3/1998 | Nguyen | B01D 53/047 | 62/648 |
| 5,901,574 | A * | 5/1999 | Rohde | F25J 5/005 | 62/640 |
| 5,966,967 | A * | 10/1999 | Agrawal | F25J 3/04054 | 62/646 |
| 6,536,234 | B1 * | 3/2003 | Shah | F25J 3/04169 | 62/646 |
| 2002/0121106 | A1 | 9/2002 | Rottmann et al. | | |
| 2008/0115531 | A1 | 5/2008 | Ha et al. | | |
| 2010/0024478 | A1 * | 2/2010 | Corduan | F25J 3/0409 | 62/643 |
| 2011/0067445 | A1 * | 3/2011 | Davidian | F25J 3/0406 | 62/652 |

FOREIGN PATENT DOCUMENTS

| | | | |
|---|---|---|---|
| EP | 1413840 | A1 | 4/2004 |
| GB | 2284880 | A1 * | 12/1994 |
| GB | 2284880 | A | 6/1995 |

OTHER PUBLICATIONS

English Abstract of DE10009977, Publication Date: Sep. 6, 2001.
English Abstract of EP1413840, Publication Date: Apr. 28, 2004.

* cited by examiner

METHOD AND DEVICE FOR THE CRYOGENIC DECOMPOSITION OF AIR

The invention relates to a method for the cryogenic separation of air which is carried out in a distillation column system for nitrogen/oxygen separation that comprises a first high-pressure column and a low-pressure column and also three condenser-evaporators, namely a high-pressure column overhead condenser, a low-pressure column bottoms evaporator, and an auxiliary condenser. The invention pertains more particularly to a low-pressure process A "low-pressure process" here means an operation in which the operating pressure at the top of the low-pressure column is less than 2.0 bar, more particularly less than 1.8 bar, more particularly less than 1.5 bar.

A "condenser-evaporator" is a heat exchanger in which a first, condensing fluid stream enters into indirect heat exchange with a second, evaporating fluid stream. Each condenser-evaporator has a liquefaction chamber and an evaporation chamber, consisting of liquefaction passages and evaporation passages, respectively. In the liquefaction chamber, a first fluid stream is condensed (liquefied); in the evaporation chamber, a second fluid stream is evaporated. Evaporation chamber and liquefaction chamber are formed by groups of passages which are in a heat exchange relationship with one another.

A condenser-evaporator may be configured, for example, as a falling film or bath evaporator. In the case of a "falling film evaporator", the fluid for evaporation flows from top to bottom through the evaporation chamber, in the course of which it undergoes partial evaporation. In the case of a "bath evaporator" (occasionally also called "circulation evaporator" or "thermosiphon evaporator"), the heat exchanger block stands in a liquid bath of the fluid for evaporation. By means of the thermosiphon effect, said fluid flows from bottom to top through the evaporation passages, and emerges again at the top in the form of a two-phase mixture. The remaining liquid flows back outside of the heat exchanger block into the bath of liquid. (In the case of a bath evaporator, the evaporation chamber may comprise not only the evaporation passages but also the external space around the heat exchanger block.)

The condenser-evaporators for the low-pressure column (the high-pressure column overhead condenser, if it is configured as a low-pressure column intermediate evaporator, and the low-pressure column bottoms evaporator) may be arranged in the interior of the low-pressure column or in one or more separate containers. The high-pressure column overhead condenser may also be arranged at the top of the first high-pressure column.

"Mass transfer elements" are understood here to be all column internals which bring about the intensive mass transfer between ascending vapor and downward-trickling liquid that is critical for the distillation (rectification). The term encompasses, in particular, conventional mass transfer trays, structured packing, and dumped packing elements (unstructured packing). For the method and the apparatus of the invention, and in the working examples, it is possible in principle for conventional mass transfer trays (such as sieve trays for example), dumped packing (unstructured packing) and/or structured packing to be used in each of the columns. Combinations of different kinds of elements in one column are also possible. On account of the small pressure loss, structured packings are preferred. They further increase the energy-saving effect of the invention.

The high-pressure column and the low-pressure column each form a separating column in the process engineering sense. They are arranged generally each in one container. Alternatively, the mass transfer elements of each column may be distributed over two or more containers, which are connected accordingly.

The feed for the auxiliary condenser is formed in one alternative by a portion of the bottoms liquid of the low-pressure column that exits the evaporation chamber of the low-pressure column bottoms evaporator; this procedure is generally selected if the low-pressure column bottoms evaporator is configured as a bath evaporator. Alternatively—as for example when using a falling film evaporator—the bottoms liquid of the low-pressure column, which runs down from the lowermost mass transfer element, is introduced into the evaporation chamber of the low-pressure column bottoms evaporator, and the unevaporated fraction of the low-pressure column bottoms liquid, which exits the low-pressure column at the bottom, is supplied at least in part to the auxiliary condenser. In the auxiliary condenser, air or a nitrogen-enriched fraction from a high-pressure column may be used as the heating medium.

In a conventional process with two condenser-evaporators for the low-pressure column, the low-pressure column bottoms evaporator is heated, together with the auxiliary condenser, with a stream of air; this is detrimental to the separation performance, since a sizeable portion of the air is preliquified and hence no longer participates in the preliminary separation in the high-pressure column.

US 2008115531 A1 discloses an auxiliary condenser process of the aforementioned kind with two condenser-evaporators for the low-pressure column, in which case there is no need for such an air stream at elevated pressure. Instead, nitrogen from the high-pressure column is brought to an increased pressure in a cold compressor, and is used as heating medium in the low-pressure column bottoms evaporator (and in the auxiliary condenser). Using a cold compressor is costly and inconvenient, and, moreover, is associated with introduction of heat at a low temperature level, which is fundamentally unfavorable from an energetic standpoint.

It is an object of the invention to design a method of this kind, and corresponding apparatus, in such a way that the cost and complexity of plant operated is relatively low and said plant can also be operated particularly favorably from an energetic standpoint.

This object is achieved by use of a distillation column system for nitrogen/oxygen separation that further comprises a second high-pressure column, the operating pressure of which is higher than the operating pressure of the first high-pressure column With the method of the invention there is no need for a cold compressor, and there is also no air preliquified in the low-pressure column bottoms evaporator. The liquefaction chamber of the low-pressure column bottoms evaporator is operated at about the pressure of the top of the second high-pressure column; in any case, the overhead gas of the second high-pressure column is not compressed before being passed into the low-pressure column bottoms evaporator, but instead enters the liquefaction chamber of said evaporator preferably at its natural pressure.

It does appear at first glance to be absurd to go to an effort and expense that appears to be very high in comparison with the use of a cold compressor, namely to use an additional separating column—the second high-pressure column—and also to compress a portion of the air to higher pressure. In the context of the invention, however, it has emerged that the energy saving is surprisingly high and that there is in fact a considerable advantage, which justifies the additional effort and expense.

In addition or, preferably, alternatively, cold can be obtained by means of a compressed nitrogen turbine, by work-producing expanding a nitrogen-enriched stream from a high-pressure column of the distillation column system for nitrogen/oxygen separation, and warming the work-producing expanded, nitrogen-enriched stream in the main heat exchanger. The nitrogen-enriched stream may come from the second high-pressure column, but is preferably taken from the first high-pressure column; it is guided, in particular without measures for pressure alteration, to the corresponding expansion machine; its entry pressure is therefore the same as the operating pressure of the corresponding high-pressure column (minus line losses).

It is advantageous here if at least one portion of the nitrogen-enriched stream warmed after the work-producing expansion is used as regenerating gas in a purifying device for feed air. This not only represents a productive use of the work-producingly expanded stream, but also decouples the low-pressure column pressure from the pressure loss experienced by the regenerating gas in the purifying device. Since the regenerating gas is not taken, as is otherwise customary, from the low-pressure column, the low-pressure column pressure may be lower accordingly, lower than 1.30 bar, for example, and hence the overall pressure level can be lowered. This further enhances the energetic efficiency of the procedure.

It is advantageous, moreover, if in the method of the invention, the high-pressure column overhead condenser is operated as a low-pressure column intermediate evaporator, by evaporating therein a liquid intermediate fraction from the low-pressure column and passing at least one portion of the intermediate fraction evaporated in the low-pressure column intermediate evaporator as ascending gas into the low-pressure column. By this means, the reflux liquid for the first high-pressure column is generated in a particularly advantageous way, and at the same time the separation performance of the low-pressure column is improved.

In a development of the method of the invention, the low-pressure column is formed by at least two sections, a first section and a second section being arranged in each case in a separate container which comprises mass transfer elements, and the second section of the low-pressure column being arranged alongside the first high-pressure column.

In the method, the low-pressure column is divided, which means that its mass transfer elements are distributed over more than one container, more particularly over precisely two containers. These containers are connected by pipelines in such a way that, all in all, the process-engineering effect of a low-pressure column is realized. As a result it is possible for the columns and condenser-evaporators to be arranged in such a way that the liquids flow into the corresponding vessels as far as possible on the basis of natural gradient.

The second section of the low-pressure column is arranged alongside the first high-pressure column. "Alongside" here means that in normal plant operation the two columns are arranged in such a way that the projections of their cross sections onto a horizontal plane do not overlap one another.

The application of a "divided low-pressure column" is indeed known per se, from DE 10009977, albeit in a very specific context with a different condenser connection mode, with increased operating pressure in the low-pressure column and a specific side column. The application of such column division to a low-pressure method in accordance with US 2008115531 A1 has therefore hitherto not been considered.

In one particularly advantageous embodiment of the invention, the first section of the low-pressure column comprises the mass transfer elements between low-pressure column intermediate evaporator and low-pressure column bottoms evaporator, and the second section comprises the mass transfer elements of the low-pressure column via which the overhead product of said column is taken off. In principle the low-pressure column may also be divided into three or more sections. Preferably precisely two sections are used.

Preferably the first section of the low-pressure column as well is arranged alongside the first high-pressure column, more particularly between the first high-pressure column and the second section of the low-pressure column. If the first high-pressure column is configured in one part and the low-pressure column in two parts, then in this case all of the sections of these columns are arranged alongside one another. The result of this is a particularly low overall height. It is useful here if the first section of the low-pressure column does not stand on the ground, but is instead mounted at a certain height, so that the liquid nitrogen, needed as reflux in the low-pressure column, does not have to be pumped. Alternatively, the first section of the low-pressure column may be arranged above the first high-pressure column.

Alternatively, the first section of the low-pressure column may be arranged over the first high-pressure column or over a further high-pressure column.

The low-pressure column intermediate evaporator is preferably arranged above or within the first section of the low-pressure column. The first case pertains to the construction in which the low-pressure column intermediate evaporator is accommodated in an external container separated from the low-pressure column; the second pertains to an internal low-pressure column intermediate evaporator, installed in the top of the first section of the low-pressure column.

It is useful, furthermore, if the low-pressure column bottoms evaporator is arranged beneath or within the first section of the low-pressure column. The first case pertains to the construction in which the low-pressure column bottoms evaporator is accommodated in an external container separated from the low-pressure column; the second pertains to an internal low-pressure column bottoms evaporator installed in the bottom of the low-pressure column.

With a divided low-pressure column, in particular, it is useful if the auxiliary condenser is arranged beneath the low-pressure column bottoms evaporator.

In a further embodiment of the method of the invention, the first and second high-pressure columns are arranged one over another, and the first high-pressure column is arranged below the second high-pressure column.

With this variant of the method of the invention, none of the customary arrangements is employed—that is, the low-pressure column is not arranged over a high-pressure column, and neither are all the columns placed alongside one another. In deviation from these conventional methods of placement, the two high-pressure columns are arranged one over another, and more particularly the second high-pressure column is arranged over the first. The low-pressure column (more particularly of one-part configuration) is preferably arranged alongside the high-pressure columns.

The latter arrangement is particularly unusual, since, indeed, it is the first high-pressure column that heats the intermediate evaporator of the low-pressure column, which is situated further up than the bottoms evaporator, which is heated by the overhead gas of the second high-pressure column, and hence initially the opposite arrangement appears more natural. In the context of the invention, however, it has emerged that with the high-pressure columns arranged one over another, and more particularly with the last-mentioned arrangement, it is possible particularly to minimize the number of pumps for conveying liquids from and to the condensers and that additionally, by virtue of the regime according to the invention, not only is the mode of operation particularly energy-saving but also the construction is relatively simple in terms of apparatus.

Furthermore, a particularly space-saving arrangement is produced, particularly as regards the base area required for the plant. The two high-pressure columns can be accommodated in a joint coldbox. This joint coldbox can be inexpensively prefabricated in the plant. It is subsequently transported as a whole, horizontally, to the building site where it is erected and connected to the other parts of the plant. The low-pressure column is preferably accommodated in a second, separate coldbox, which can be prefabricated and transported in a similar way.

An arrangement of two columns "one over another" here means that the top end of the lower of the two columns is located at a lower geodetic height than the lower end of the upper of the two columns, and the projections of the two columns into a horizontal plane overlap. For example, the two columns are arranged precisely over one another, meaning that the axes of the two columns extend on the same vertical line. This definition applies, analogously, to similar terms such as "above" and "below".

The auxiliary condenser is preferably arranged between the first and second high-pressure columns, more particularly over the first high-pressure column and under the second high-pressure column.

This appears at first to be illogical, since the auxiliary condenser is functionally connected to none of these columns. Overall, however, the resulting arrangement is very compact, and the two high-pressure columns and the auxiliary condenser can be accommodated in a joint coldbox. This joint coldbox may, as already explained above, be inexpensively prefabricated in the plant, without the need for a dedicated coldbox for the auxiliary condenser or any need for the coldbox of the low-pressure column, which in general is already at some height, to be raised further. With this arrangement, moreover, on account of a sufficiently high hydrostatic pressure, there is no need for a LOX product pump in order to convey liquid oxygen product into a storage tank.

Air is used as heating medium in the auxiliary condenser, preferably, by the at least partial condensation in the auxiliary condenser of a third feed air stream, which more particularly is under a third pressure, which is higher than the first pressure. For example, the third pressure is equal to the second pressure, and the second and third feed air streams are branched off from a common air substream which has been brought beforehand to a correspondingly increased pressure.

Pressures are said here to be the "same" when the pressure difference between the corresponding points is not greater than the natural line losses which result from pressure losses in pipelines, heat exchangers, condensers, adsorbers, etc.

In the context of the invention it is useful if the first feed air stream is compressed only to the first pressure (plus line losses) and only the second (optionally together with the third) feed air stream is compressed, or boosted, to the correspondingly higher second pressure (plus line losses). This is implemented in a particularly advantageous way by:

- compressing the total air stream to a first total air pressure, which is higher than the first pressure but lower than the second pressure,
- dividing the total air stream at the first total air pressure into a first air substream and a second air substream,
- passing the first air substream at approximately the first total air pressure into the main heat exchanger where it is cooled,
- the first feed air stream for the first high-pressure column being formed by at least one portion of the cooled first air substream,
- boosting the pressure of the second air substream to a pressure which is higher than the first total air pressure,
- introducing the boosted second air substream into the main heat exchanger, where it is cooled, and
- the second feed air stream for the second high-pressure column being formed by at least one portion of the cooled second air substream.

In principle, the feed air streams can be supplied jointly and the lower pressure level to a joint air purification facility. In many cases, however, it is more useful to provide two separate purification devices, which are operated at the two different pressures, as is known per se from EP 342436.

It is useful if the third feed air stream as well is formed by at least one portion of the cooled second air substream. Second and third feed air streams are therefore brought jointly to an increased pressure (for example, to the second or third pressure plus line losses) and then are passed separately from one another into the second high-pressure column and the auxiliary condenser, respectively. Alternatively, the entire second air substream may be passed as second feed air stream through the auxiliary condenser, partially condensed therein only to a small extent, and then passed as first feed air stream into the second high-pressure column. The third pressure (in the liquefaction chamber of the auxiliary condenser) is preferably the same as the second pressure (on entry of the second feed air stream into the second high-pressure column).

Additionally or alternatively to the aforementioned compressed nitrogen turbine, in the method, process cold for the compensation of replacement losses and isolation losses, and possibly for the liquefaction of the product, may be obtained, for example, by means of an air injection turbine, by work-producingly expanding a fourth feed air stream and passing it into the low-pressure column. The fourth feed air stream may be compressed, for example, to the same pressure level as the first feed air stream for the first high-pressure column, and supplied, for instance, at the first pressure to the corresponding expansion machine.

The auxiliary condenser is preferably configured as a bath evaporator. In one specific variant of the invention, all of the condenser-evaporators of the method are configured as bath evaporators. Particularly in the case of high-pressure columns arranged over one another, this results in a particularly cost-effective construction and a particularly reliable mode of operation.

In one particularly useful variant embodiment of the invention—particularly in the case of high-pressure columns arranged one over another—the low-pressure column bottoms evaporator is arranged at the top of the second high-pressure column; in other words, the low-pressure column bottoms evaporator sits above the second high-pressure column, and the reflux liquid generated therein is able to flow into the top of the second high-pressure column by virtue of the natural gradient (hence without a liquid nitrogen pump). The low-pressure column bottoms evaporator is preferably arranged directly over the top of the second high-pressure column, like a conventional overhead condenser. The second high-pressure column and the low-pressure column bottoms evaporator here may be accommodated in a joint container, with a dividing wall arranged between evaporation chamber of the low-pressure column bottoms evaporator and top region of the second high-pressure column.

Further energy can be saved through the use of one or more falling film evaporators. In particular, the low-pressure column intermediate evaporator and/or low-pressure column bottoms evaporator may be embodied as falling film evaporators. The auxiliary condenser, in contrast, may be embodied as a bath evaporator or, alternatively, likewise as a falling film evaporator.

In the method of the invention, additionally, a third high-pressure column may be used. It is preferably operated at a higher pressure than the second high-pressure column. Its overhead gas may then be used as heating means for the auxiliary condenser. The preliminary liquefaction of air becomes lower accordingly.

The invention further relates to apparatus for the cryogenic separation of air in a distillation column system for nitrogen/oxygen separation, having a distillation column system for nitrogen/oxygen separation that comprises a first high-pressure column, a low-pressure column, and three condenser-evaporators, namely a high-pressure column overhead condenser, a low-pressure column bottoms evaporator, and an auxiliary condenser. The apparatus further comprises:

- a main heat exchanger for cooling a first feed air stream,
- means for introducing the cooled first feed air stream at a first pressure into the first high-pressure column,
- means for introducing gaseous overhead nitrogen from the first high-pressure column into the liquefaction chamber of the high-pressure column overhead condenser,
- means for applying at least one portion of the overhead nitrogen condensed in the high-pressure column overhead condenser as reflux liquid to the first high-pressure column,
- means for passing at least one portion of the bottoms liquid of the low-pressure column into the evaporation chamber of the low-pressure column bottoms evaporator,
- means for passing a heating fluid into the liquefaction chamber of the low-pressure column bottoms evaporator,
- means for passing an unevaporated portion of the bottoms liquid of the low-pressure column into the evaporation chamber of the auxiliary condenser,
- means for obtaining at least one portion of the liquid evaporated in the auxiliary condenser as a gaseous oxygen product, a second high-pressure column,
- means for passing a second feed air stream in the main heat exchanger,
- means for passing the second feed air stream cooled in the main heat exchanger into the second high-pressure column,
- means for passing at least one portion of the overhead gas of the second high-pressure column as heating fluid into the liquefaction chamber of the low-pressure column bottoms evaporator, and
- regulating means whose effect is that the second feed air stream is passed at a second pressure, which is higher than the first pressure, into the second high-pressure column.

The apparatus of the invention may be supplemented by apparatus features which correspond to the features of the dependent method claims.

The invention and also further details of the invention are elucidated in more detail below, by means of working examples which are represented schematically in the drawings. In these drawings:

Figure 1:
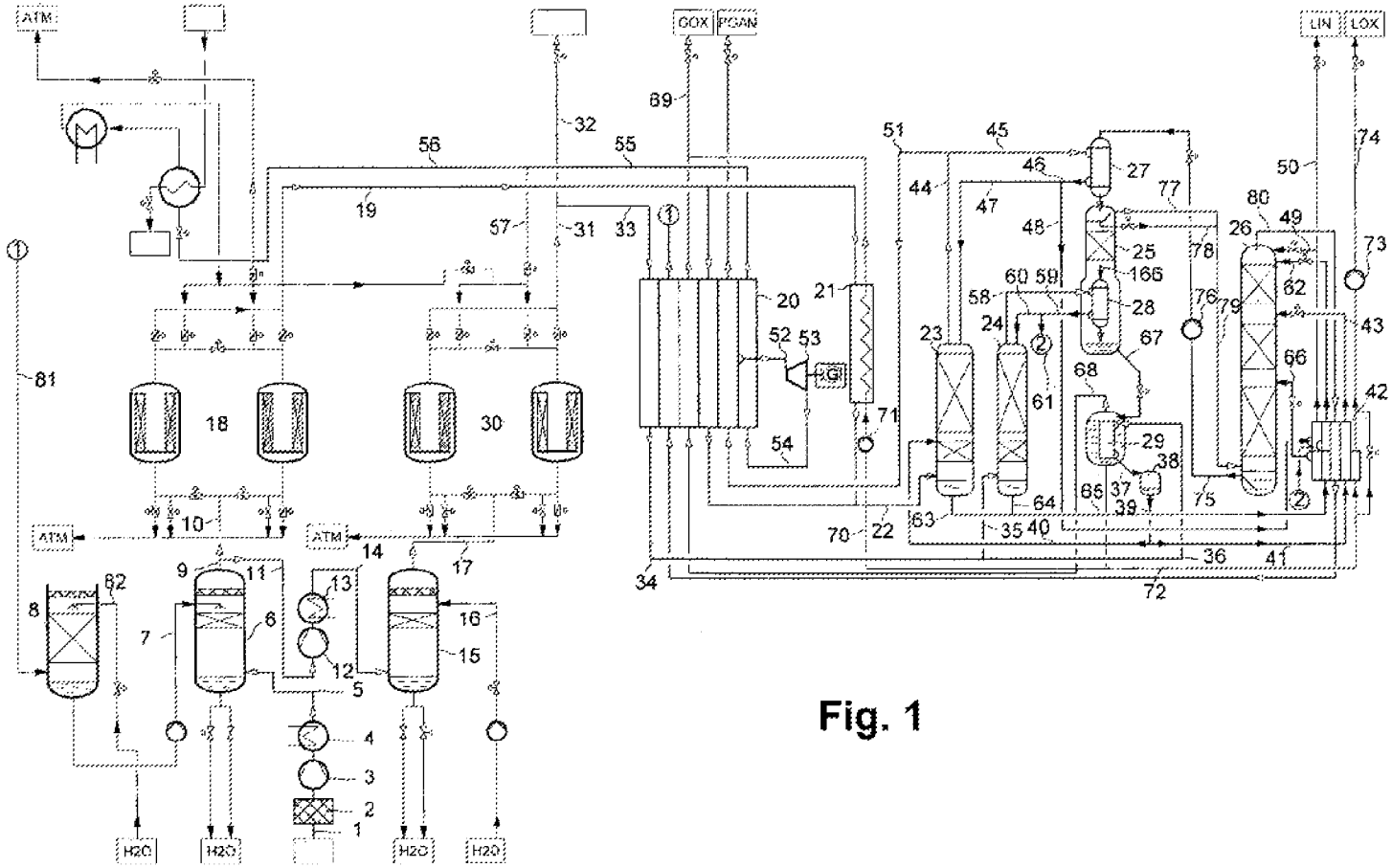
FIG. 1 shows a first working example of the invention with compressed nitrogen turbine and two purifying devices at different pressure levels.

Atmospheric air 1 is drawn in, in FIG. 1, by a main air compressor 3 with aftercooler 4 via a filter 2, and is compressed therein to a first total air pressure of 3.1 bar. The main air compressor may have two or more stages with intercooling; for reasons of redundancy, it is preferably of two-line configuration (both not shown in the drawing). The total air stream 5 is supplied at the first total air pressure and at a temperature of 295 K to a first direct contact cooler 6, where it is cooled further to 283 K in direct heat exchange with cooling water 7 from an evaporative cooler 8. The cooled total air stream 9 is divided into a first air substream 10 and a second air substream 11.

The second air substream 11 is compressed from the first total air pressure (minus pressure losses) to a second total air pressure of 4.9 bar in a booster 12 with aftercooler 13. The booster may have two or more stages with intercooling; for reasons of redundancy, it is preferably of two-line configuration (both not shown in the drawing). One line each of the main air compressor and of the booster can be configured as one machine with a shared drive, more particularly in the form of a geared compressor. The second air substream is then cooled from 295 K to 290 K in a second direct contact cooler 15, in direct heat exchange with a warmer cooling water stream 16.

The first air substream is purified in a first purifying device 18, which is operated at the first total air pressure, and then is passed at this pressure via line 19 to the warm end of a main heat exchanger, which in the working example is formed by two blocks 20, 21 connected in parallel. The air, cooled to approximately dew point, forms a "first feed air stream" 22, which is supplied to a first high-pressure column 23.

The first high-pressure column 23 is part of a distillation column system for nitrogen/oxygen separation, which, in addition, has a second high-pressure column 24, a low-pressure column, consisting of two sections 25 and 26, a high-pressure column overhead condenser, which in all working examples shown here is configured as a low-pressure column intermediate evaporator 27, a low-pressure column bottoms evaporator 28, and an auxiliary condenser 29. The low-pressure column intermediate evaporator 27 and the low-pressure column bottoms evaporator 28 are configured as falling film evaporators, the auxiliary condenser 29 as a bath evaporator.

The precooled second air substream 17 is purified in a second purifying device 30, which is operated at the second total air pressure. From the purified second air substream, via line 32, it is possible to withdraw a small portion, which is used as instrument air or for purposes other than air fractionation. The remainder flows via line 33 to the main heat exchanger 20, where it is cooled. The cooled second air substream 34 is divided into a "second feed air stream" 35, which is passed into the second high-pressure column 24, and into a "third feed air stream" 36, which is passed to the liquefaction chamber of the auxiliary condenser 29.

The at least partially, preferably substantially completely, condensed third substream 37 is passed into a separator (phase separator) 38. A first portion 40 of the liquid fraction 39 is passed to the first high-pressure column 23. A second portion 41 thereof is fed into the low-pressure column 26 via a subcooling countercurrent heat exchanger 42 and line 43.

Nitrogen-rich overhead gas 44 of the first high-pressure column 23 is condensed, in a first portion, in the low-pressure column intermediate evaporator 27. Liquid nitrogen 46 obtained in this process is applied, in a first portion 47, as reflux to the top of the first high-pressure column 23. A second portion 48 is cooled in the subcooling countercurrent heat exchanger 42, and is applied via line 49 as reflux to the top of the low-pressure column 46. A portion 50 of the subcooled liquid can be recovered, as and when required, as a liquid product (LIN).

A second portion 51 of the nitrogen-rich overhead gas 44 of the first high-pressure column 23 is passed into the main heat exchanger 20. At least one portion 52 thereof is only warmed to an intermediate temperature, and then is work-producingly expanded in a generator-braked compressed nitrogen turbine 53 from 2.7 bar to 1.25 bar. The outlet pressure of the turbine is just sufficient to force the work-producingly expanded stream 54 through the main heat exchanger 20 and, via lines 55, 56, and 57, as regenerating gas, through the first and second purifying devices 18 and 30.

A further portion of the stream 51 is warmed to ambient temperature in the main heat exchanger 20, and is recovered as gaseous pressurized nitrogen product (PGAN).

Nitrogen-rich overhead gas 58 of the second high-pressure column 24 is condensed in the low-pressure column bottoms evaporator 28. Liquid nitrogen 59 obtained in this process is applied, in a first portion 60, as reflux to the top of the second high-pressure column 24. A second portion 61 is cooled in the subcooling countercurrent heat exchanger 42 and is applied via line 62, as reflux, to the top of the low-pressure column 26.

The bottom liquids 63 and 64 of the two high-pressure columns 23 and 24 are combined and fed via line 65, the subcooling countercurrent heat exchanger 42, and line 66 into the low-pressure column 26.

The bottom liquid 166 of the low-pressure column 25 is passed into the evaporation chamber of the low-pressure column bottoms evaporator 28, where it is partially evaporated. The fraction 67 that has remained in liquid form flows into the evaporation chamber of the auxiliary condenser 29, where it is partially evaporated. The fraction 68 evaporated in the auxiliary condenser is passed to the cold end of the main heat exchanger block 20, warmed to approximately ambient temperature, and finally recovered via line 69 as a gaseous oxygen product (GOX) with purity of 95 mol %. The fraction that has remained in liquid form is, in a portion 70, in a pump 71, to a pressure of 6 bar, evaporated and warmed in the main heat exchanger block 21, and finally admixed to the gaseous oxygen product 69. Another portion 72 can be recovered as liquid oxygen product (LOX) via the subcooling countercurrent heat exchanger 42, pump 73, and line 74.

A liquid intermediate fraction 75, which is produced at the lower end of the second low-pressure column section 26, is conveyed by means of a pump 76 into the evaporation chamber of the low-pressure column intermediate evaporator 27, where it is partially evaporated. Steam generated in this process is passed, together with the steam produced at the top of the first low-pressure column section 25, via the lines 77 and 79, into the second low-pressure column section 26, optionally together with circulating purge liquid 78. The remainder of the intermediate fraction that has remained in liquid form is used as reflux liquid in the first low-pressure column section 25.

At the top of the low-pressure column 26, nitrogen-rich residual gas 80 is taken off at a pressure of 1.26 bar and, after being warmed in subcooling countercurrent heat exchanger 42 and main heat exchanger 20, is fed via line 81, in virtually unpressurized form, as dry gas, into the evaporative cooler 8, where it is utilized for the cooling of cooling water 82.

Figure 2:
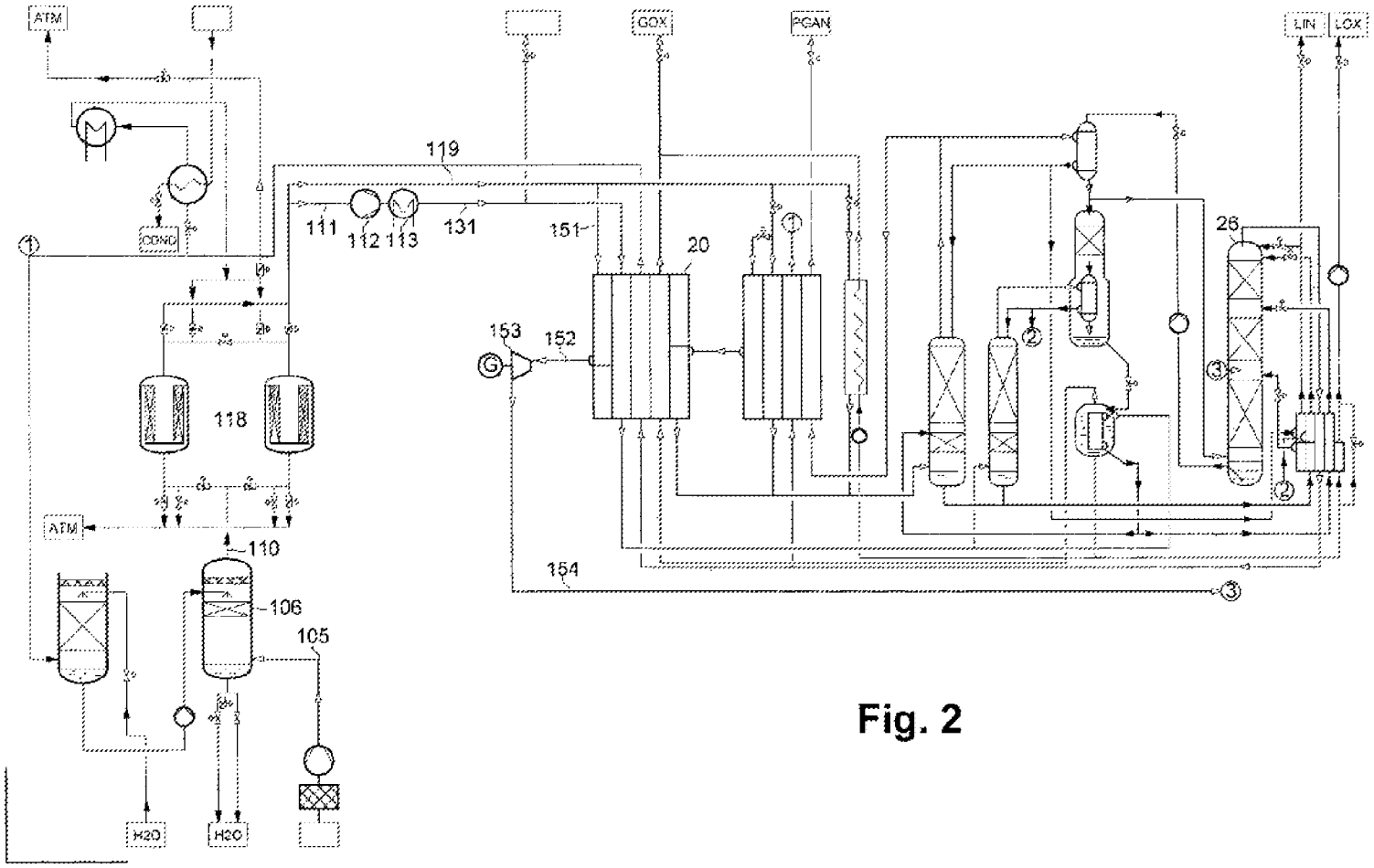
FIG. 2 shows a second working example with air injection turbine and a joint purifying device.

FIG. 2 differs from FIG. 1 in respect of two process sections: the generation of cold, and the compression of air with preliminary cooling and purification. In the text below, only the differing aspects are elucidated in more detail, and may both, independently of one another, be combined with the other process sections.

Cold is generated here not by a compressed nitrogen turbine, but instead by an air injection turbine 153. This turbine is operated with a "fourth feed air stream" 151, 152, which has been branched off from the first air substream 119 at the lower first total air pressure, and cooled in the main heat exchanger 20 to an intermediate temperature. The work-producingly expanded fourth feed air stream 154 is supplied to the low-pressure column 26 at a suitable intermediate location.

The compression of air is performed more simply here than in figure, and in particular has only one single purifying device 118, in which the total air 105, 110 is purified at the first total air pressure. Also, only one direct contact cooler 106 is used.

The division into the first air substream 119 and the second air substream 111 is performed here downstream of the purifying device 118. The booster 112 is constructed as in FIG. 1, but only has a usual aftercooler 113, and the air is not cooled further in a direct contact cooler. The second air substream is then guided via line 119 in analogy to line 19 in FIG. 1.

Figure 3:
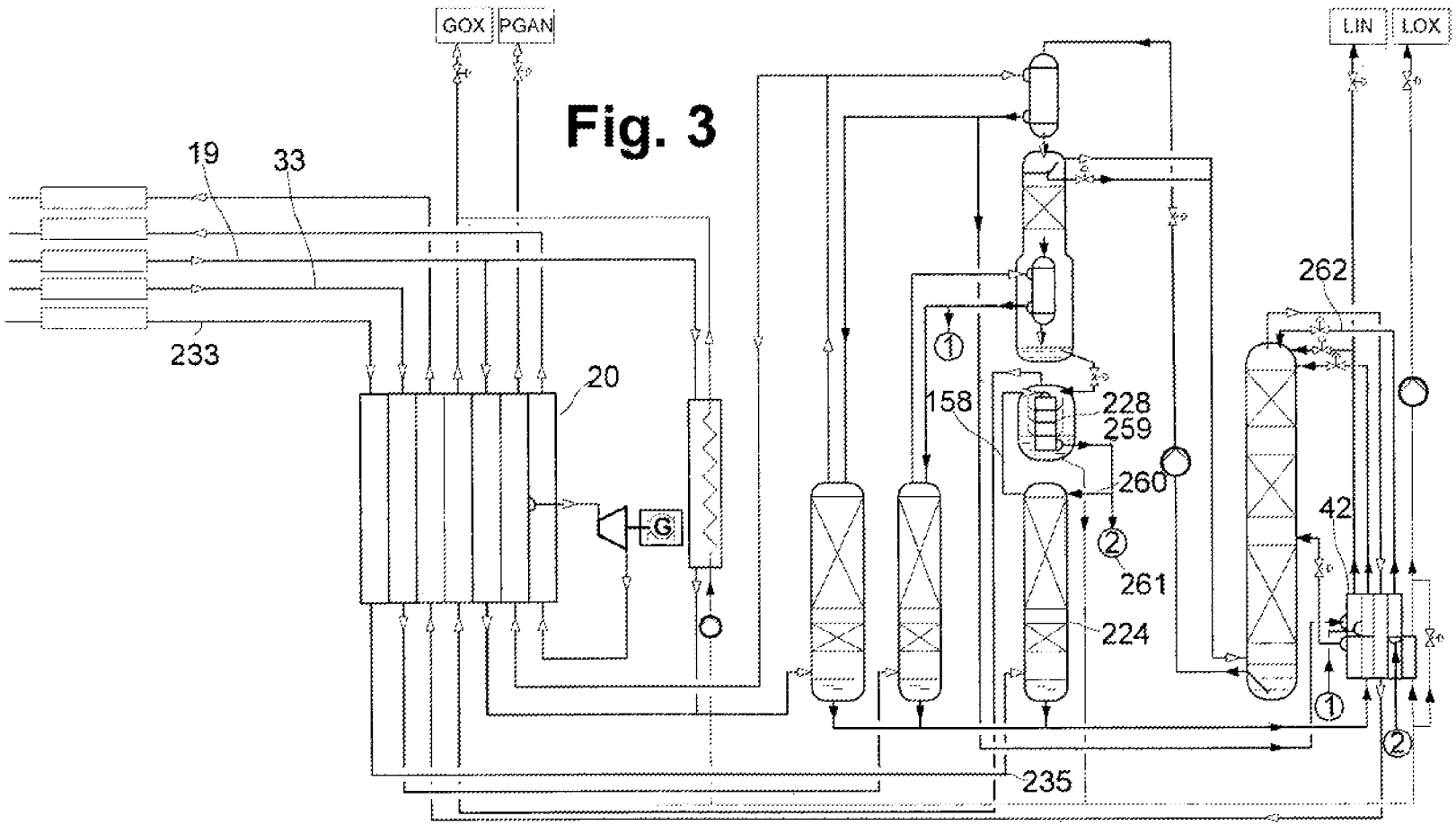
FIG. 3 shows a third working example with three high-pressure columns.

FIG. 3 corresponds largely to FIG. 1. The warm section of the process is not shown, and may be configured as in FIG. 1 or as in FIG. 2.

As well as the first air substream 19 at the first pressure and the second air substream, a high-pressure feed air substream 233 is passed into the main heat exchanger 20. The cold high-pressure feed air stream 235 enters at a third pressure of 5.3 bar into a third high-pressure column 224. The nitrogen-rich overhead gas 258 is employed as heating means in the auxiliary condenser 228, where it is substantially completely condensed. Liquid nitrogen 259 obtained in this process is applied, in a first portion 260, as reflux to the top of the second high-pressure column 24. A second portion 261 is cooled in the subcooling countercurrent heat exchanger 42, and is applied via line 262 as reflux to the top of the low-pressure column 26.

In the case of this working example, the auxiliary condenser 228 is realized in the form of a multistory bath evaporator, more particularly as a cascade evaporator, in which the individual stories are connected serially on the evaporation side and in parallel on the liquefaction side. In this case it is possible to use any corresponding embodiment of a cascade evaporator, more particularly those which are described in detail in EP 1077356 A1, WO 0192798 A2=US 2005028554 A1, WO 01092799 A1=US 2003159810 A1, WO 03012352 A2, or DE 102007003437 A1.

Figure 4:
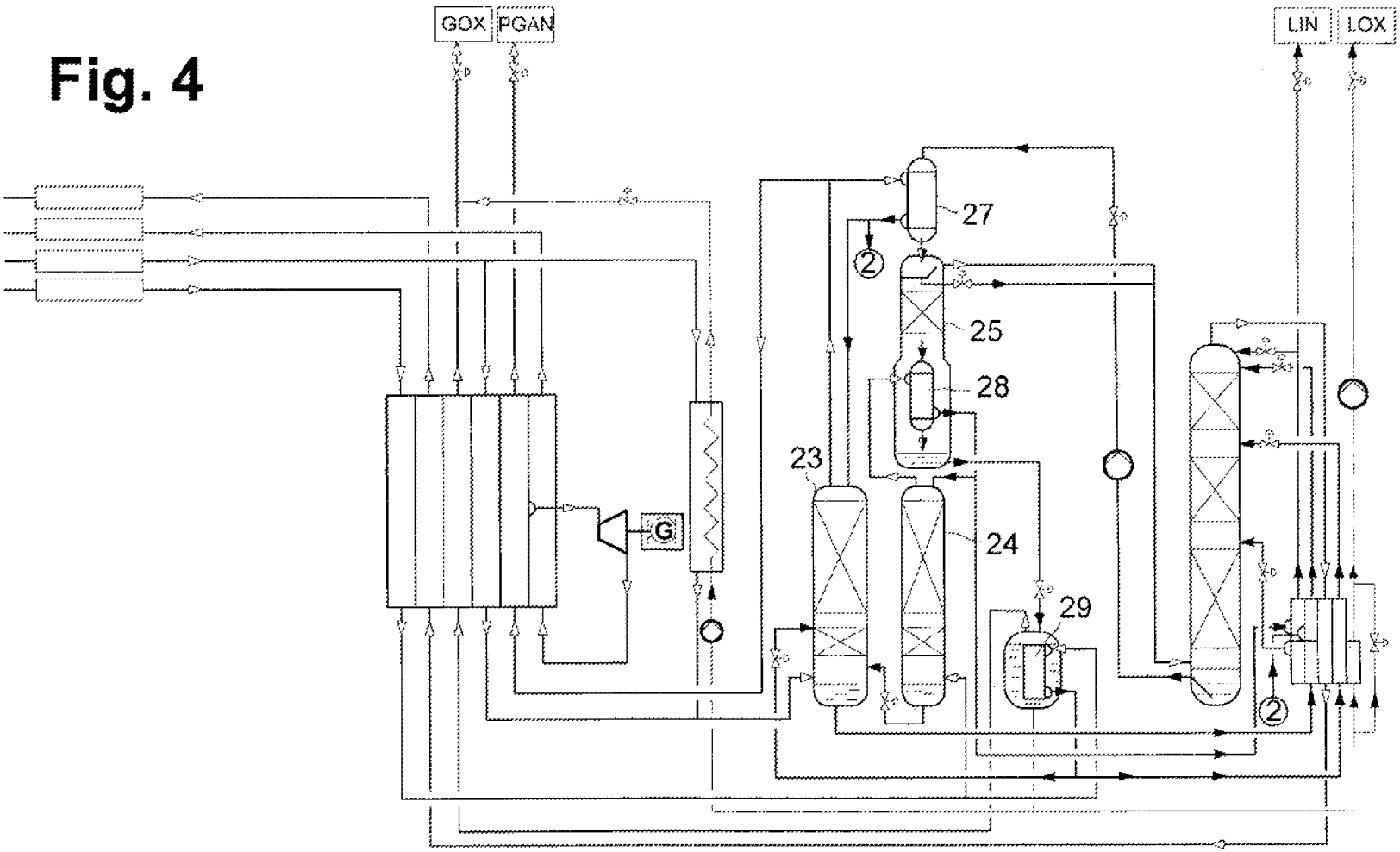
FIG. 4 shows a working example with the first section of the low-pressure column arranged over the second high-pressure column.
Figure 5:
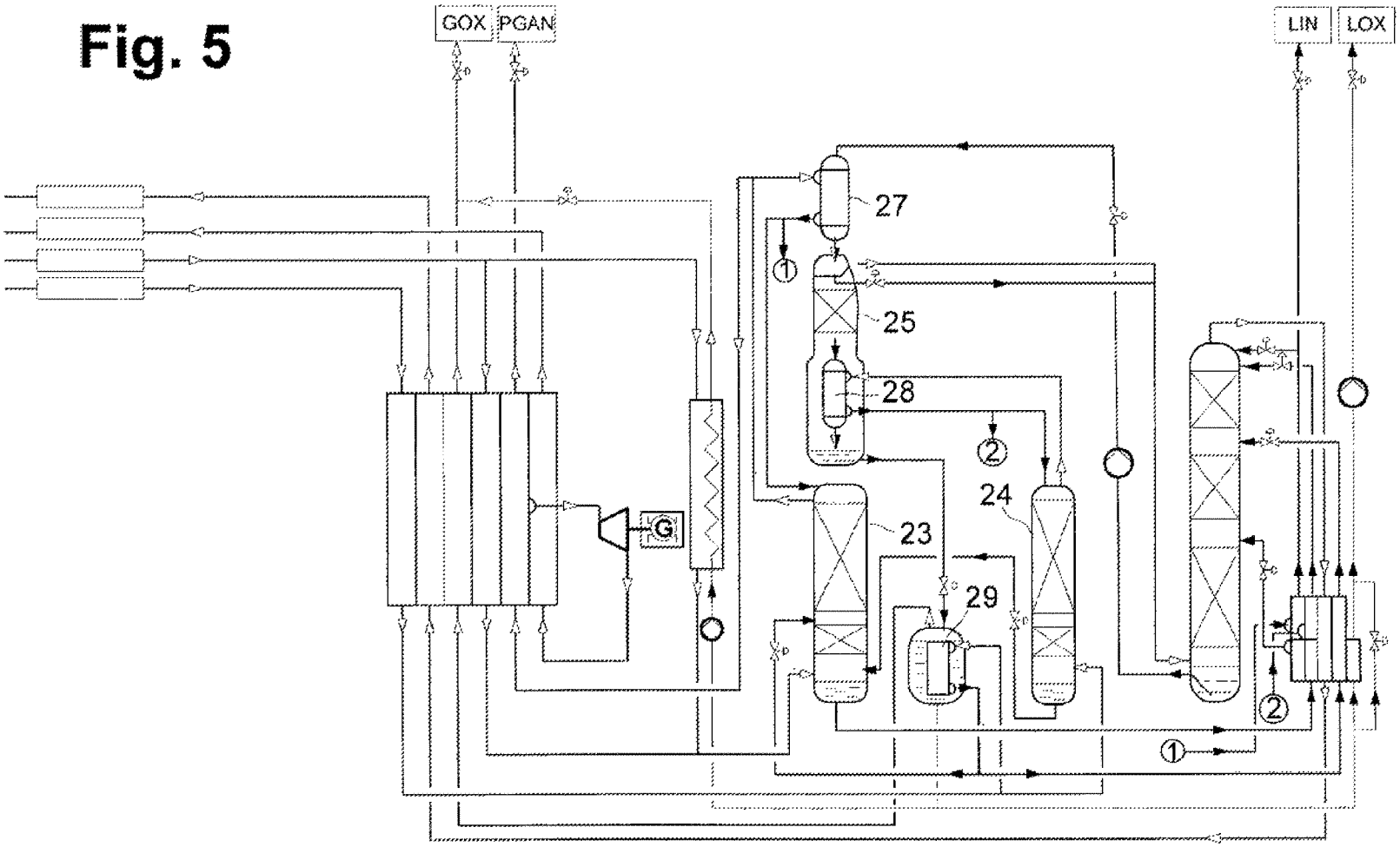
FIG. 5 shows a working example with the first section of the low-pressure column arranged over the first high-pressure column.
Figure 6:
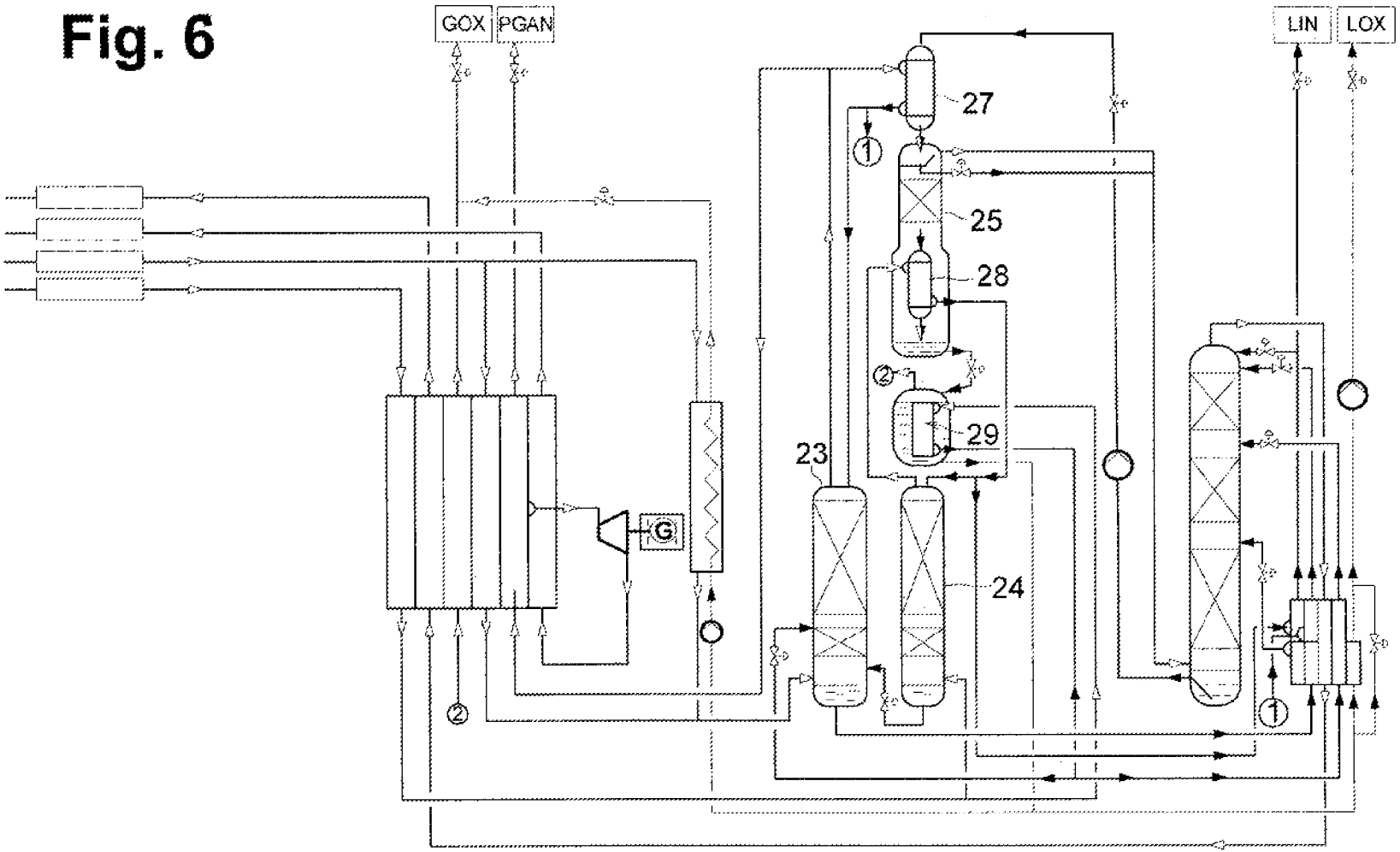
FIG. 6 shows a further working example with an auxiliary condenser arranged between two separating columns.

Instead of the compressed nitrogen turbine 53, it is possible in the method of FIG. 3 to use an air injection turbine as well, as also in subsequent FIGS. 4 to 6.

As shown in FIG. 3, the third high-pressure column 224 is preferably below the auxiliary condenser 228 or the combination of auxiliary condenser 228, low-pressure column bottoms evaporator, first section of the low-pressure column, and low-pressure column intermediate evaporator. The spatial arrangement of the remaining columns corresponds to that of FIGS. 1 and 2.

FIG. 4 differs from FIG. 1 in that the first section 25 of the low-pressure column with the two evaporators 27 and 28 is arranged over the second high-pressure column 24.

In FIG. 5, in contrast, the first section 25 of the low-pressure column with the two evaporators 27 and 28 is arranged over the first high-pressure column 23.

The auxiliary condenser 29 of FIG. 6 is arranged between the second high-pressure column 24 and the first section 25 of the low-pressure column. FIG. 6 otherwise corresponds to the working example of FIG. 4. The arrangement of the auxiliary condenser 29 between two separating columns, in accordance with FIG. 6, may also be transposed to the working example of FIG. 5.

Figure 7:
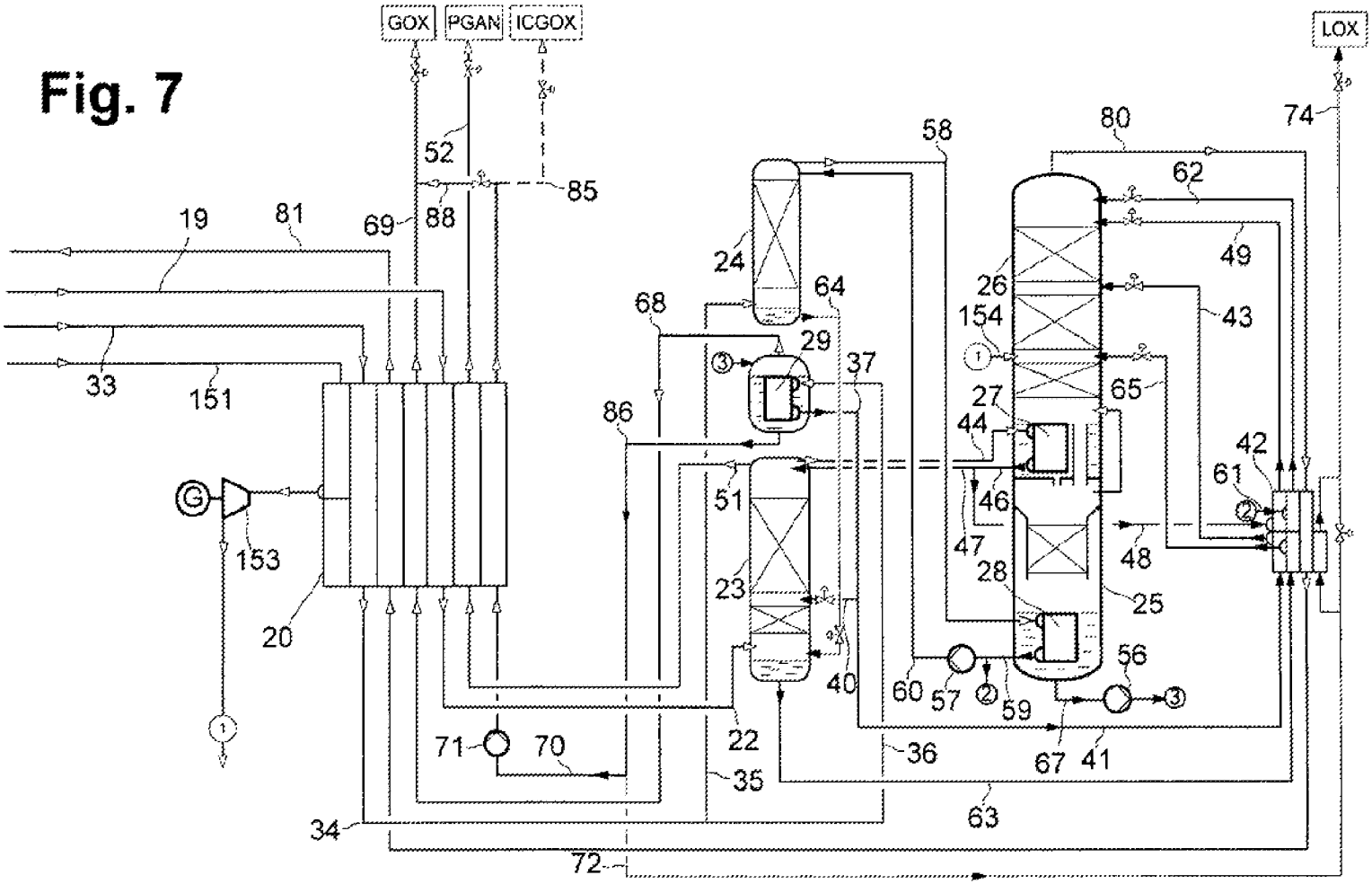
FIG. 7 shows a first working example of the variant of the invention in which the high-pressure columns are arranged one over another, with the auxiliary condenser arranged between the two high-pressure columns.
Figure 8:
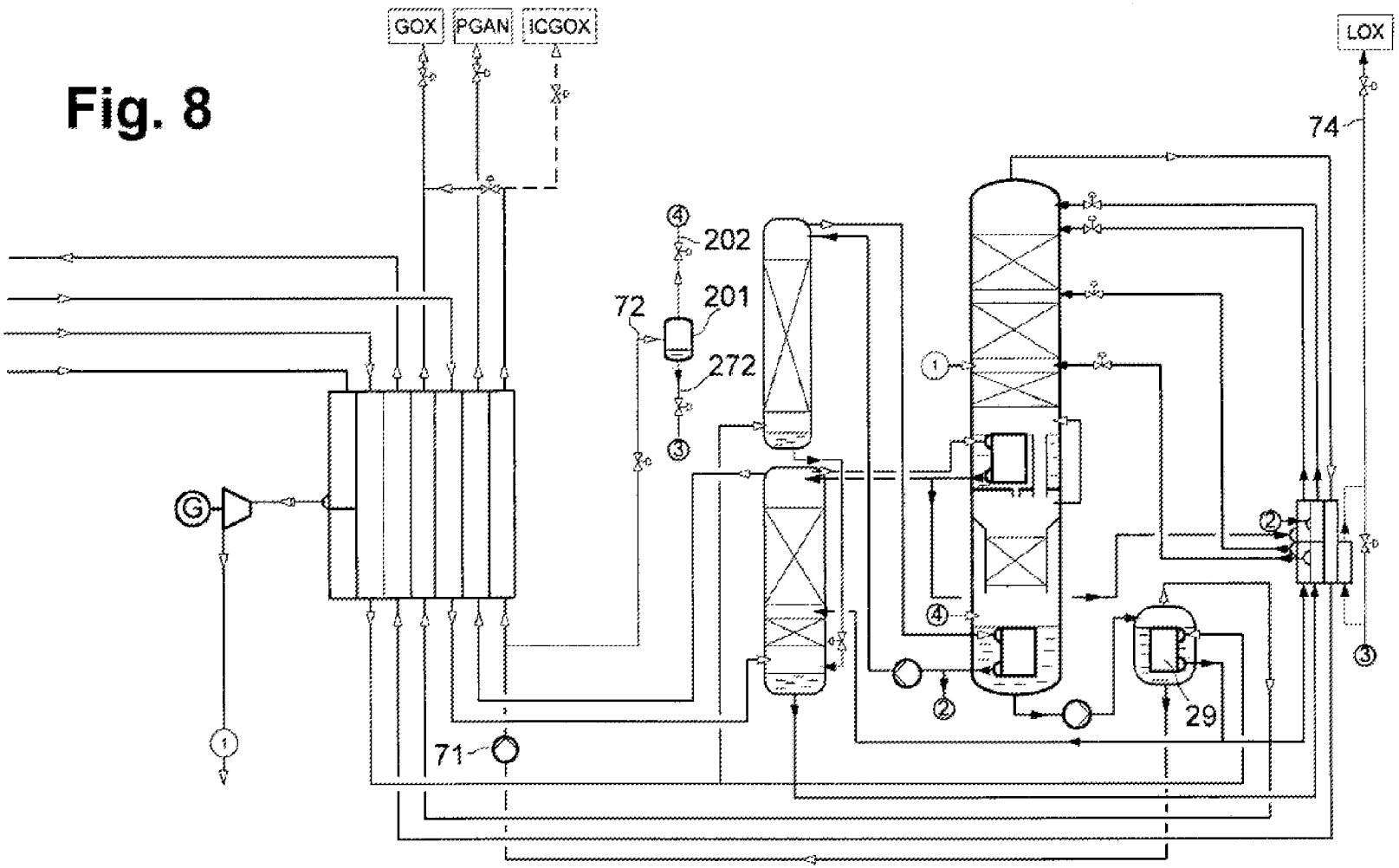
FIG. 8 shows a second working example of this variant of the invention, with the auxiliary condenser arranged alongside the separating columns.
Figure 9:
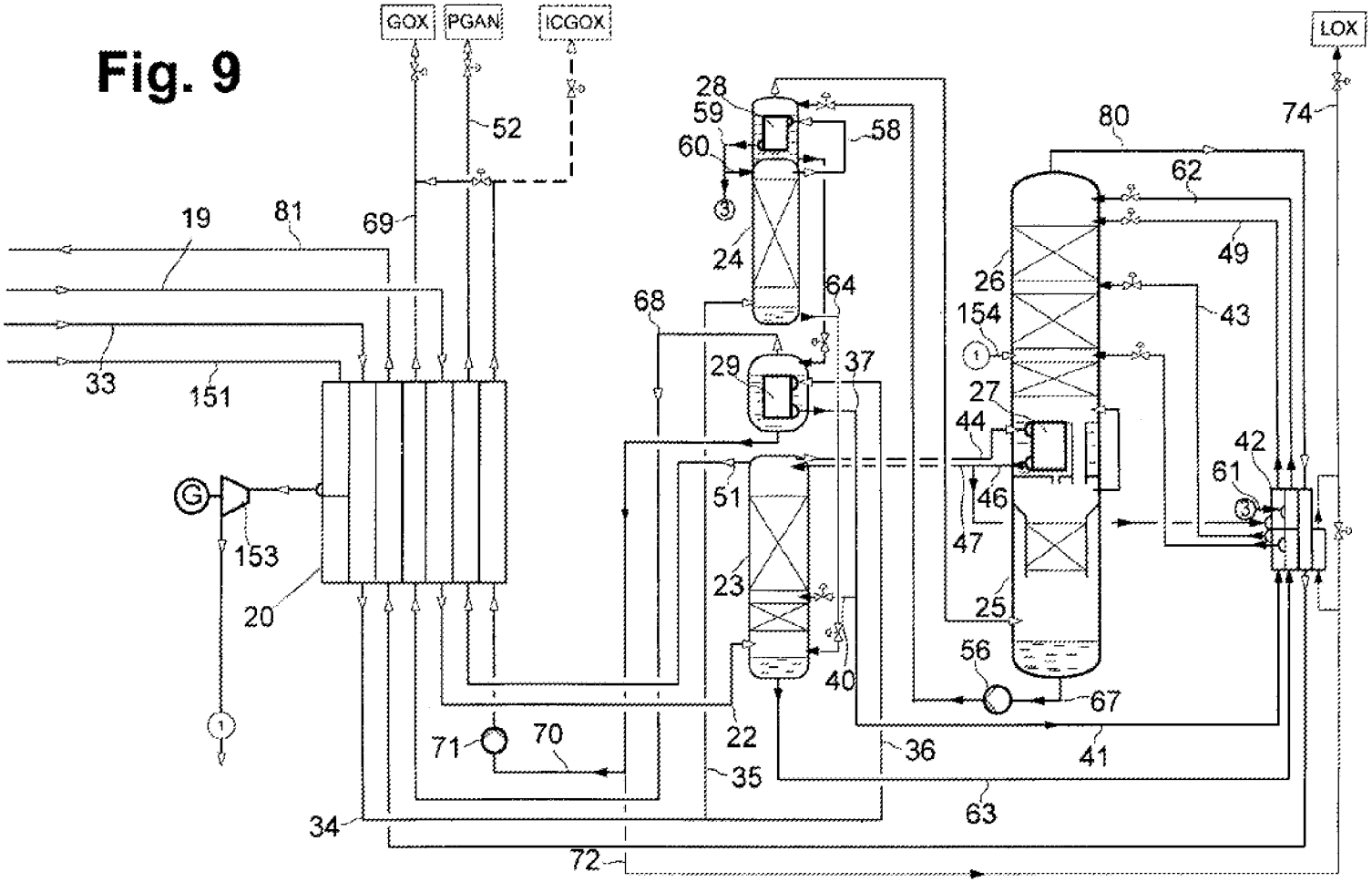
FIG. 9 shows a third working example of this variant of the invention, with the low-pressure column bottoms evaporator arranged at the top of the second high-pressure column.

The compression and purification of the feed air, and also any diversion of instrument air, is not shown in FIGS. 7 to 9. The two air streams necessary for the method, with different pressures, are supplied with only one air compressor, consisting of two sections. The entire feed air is brought here in the first, two-stage section to a pressure of approximately 3.8 bara, and passed exclusively into the preliminary cooling system. Following preliminary cooling and purification, around half the feed air is passed back into the second (one-stage) compressor section, and compressed dry to a final pressure of approximately 5.35 bar. Such compression and purification of the feed air is shown in detail in FIG. 2.

A first air substream 19 is passed in FIG. 7, at a first pressure of approximately 3.6 bar, to the warm end of a main heat exchanger 20. The air, cooled to approximately dew point, forms a "first feed air stream" 22, which is supplied to a first high-pressure column 23.

The first high-pressure column 23 is part of a distillation column system for nitrogen/oxygen separation, which also has a second high-pressure column 24, a low-pressure column, a low-pressure column intermediate evaporator 27, a low-pressure column bottoms evaporator 28, and an auxiliary condenser 29. In the working example, all of these condensers are configured as bath evaporators.

In the working example of FIG. 7, and also in the subsequent FIGS. 8 and 9, the two high-pressure columns 23 and 24 are arranged over one another, with the first high-pressure column 23 below the second high-pressure column 24. The low-pressure column is of one-part configuration—that is, its two sections 25 and 26 below and above the low-pressure column intermediate evaporator 27 are arranged in a shared container—and it stands on the ground. The combination of the two high-pressure columns and the low-pressure column are arranged alongside one another.

A second air substream 33 flows at a second pressure of approximately 5.25 bar to the main heat exchanger 20, where it is cooled. The cooled second air substream 34 is divided into a "second feed air stream" 35, which is passed into the second high-pressure column 24, and into a "third feed air stream" 36, which is passed to the liquefaction chamber of the auxiliary condenser 29.

The at least partially, preferably substantially completely, condensed third substream 37 is passed, in a first fraction 40, to the first high-pressure column 23. In a second portion 41, it is fed via a subcooling countercurrent heat exchanger 42 and line 43 into the low-pressure column 26.

Nitrogen-rich overhead gas of the first high-pressure column 23 is condensed, in a first fraction 44, in the low-pressure column intermediate evaporator 27. Liquid nitrogen 46 obtained in this process is applied, in a first portion 47, as reflux to the top of the first high-pressure column 23. A second portion 48 is cooled in the subcooling countercurrent heat exchanger 42, and is applied via line 49, as reflux, to the top of the low-pressure column 26. A portion of the subcooled liquid can be recovered, as and when required, as a liquid product (not shown).

A second portion 51 of the nitrogen-rich overhead gas of the first high-pressure column 23 is warmed to an intermediate temperature in the main heat exchanger 20. The warmed pressurized nitrogen 52 is obtained as a gaseous pressurized nitrogen product (PGAN).

Nitrogen-rich overhead gas 58 of the second high-pressure column 24 is condensed in the low-pressure column bottoms evaporator 28. Liquid nitrogen 59 obtained in this process is applied in a first portion 60, by means of a pump 57, as reflux, to the top of the second high-pressure column 24. A second portion 61 is cooled in the subcooling countercurrent heat exchanger 42 and is applied via line 62, as reflux, to the top of the low-pressure column 26.

The bottom liquid 64 of the second high-pressure column 24 is passed into the first high-pressure column 23, at the bottom and/or somewhat above. The bottom liquid 63 of the first high-pressure column 23 is fed via the subcooling countercurrent heat exchanger 42 and line 65 into the low-pressure column 26.

The bottom liquid of the low-pressure column 25 is passed into the evaporation chamber of the low-pressure column bottoms evaporator 28, where it is partially evaporated. The fraction 67 that has remained in liquid form flows via a pump 56 into the evaporation chamber of the auxiliary condenser 29, where it is partially evaporated at a pressure of approximately 1.65 bar. The fraction 68 evaporated in the auxiliary condenser is passed to the cold end of the main heat exchanger 20, warmed to about ambient temperature, and finally recovered, via line 69, as gaseous oxygen product (GOX), in this specific case with a purity of about 93 mol %. The fraction 86 that has remained in liquid form is brought to higher pressure in a pump 71, in a portion 70, and is evaporated in the main heat exchanger 20 (or pseudo-evaporated, if the pressure is supercritical) and warmed.

If only a small purge amount is run via the pump 71, the higher pressure of the pumped oxygen ought to be supercritical. The warmed purge stream is then admixed via line 88 to the gaseous oxygen product 69 or, alternatively, taken off as a separate product.

In a differing embodiment (line 85 drawn in a dashed line), a portion of the oxygen product is recovered as internally compressed product ICGOX (for example, 15% of the total amount of oxygen at a pressure of 7 bar). As a result, the auxiliary condenser 29 is likewise very well purged. In this case it is sufficient if the pump 71 brings the liquid oxygen to the desired product pressure (plus line losses).

A further portion 72 of fraction 86 that is in liquid form, from the auxiliary condenser 29, can be recovered as liquid oxygen product (LOX) via the subcooling countercurrent heat exchanger 42 and line 74.

At the top of the low-pressure column 26, nitrogen-rich residual gas 80 is taken off under a pressure of approximately 1.33 bar and, after being warmed in subcooling countercurrent heat exchanger 42 and main heat exchanger 20, is taken off via line 81 and is available as dry gas for an evaporative cooler (not shown) 8, for the cooling of cooling water, or can be utilized as regenerating gas in a device for the purification of feed air (likewise not shown).

In the process, cold is generated by means of an air injection turbine 153. This turbine is operated with a "fourth feed air stream" 151, which—like the first air substream 19—is at the lower first pressure and has been cooled to an intermediate temperature in the main heat exchanger 20. The work-producingly expanded fourth feed air stream 154 is supplied to the low-pressure column 26 at a suitable intermediate location.

FIG. 8 differs from FIG. 7 in that the auxiliary condenser 29 is arranged alongside the columns.

Here, moreover, the liquid oxygen product 74 is obtained under pressure, by the corresponding stream 72 being branched off downstream of the pump 71 and separated, in a separator 201, into a gaseous fraction 202 and a liquid fraction 272. This variant is especially advantageous when, with the pump 71, relatively large amount is generated as internally compressed product (ICGOX). This pump is then used at the same time as product pump for the liquid oxygen product. The separator 201 is installed relatively high in the coldbox, and the liquid product 272 flows from this separator by means of hydrostatic pressure into the storage tank.

FIG. 9 corresponds largely to FIG. 8. However, the low-pressure column bottoms evaporator 28 is arranged not in the bottom of the lower low-pressure column section 25 but instead at the top of the second high-pressure column 24, in other words above the second high-pressure column. As a result, the system operates without a liquid nitrogen pump. The reflux liquid 60 flows to the top of the second high-pressure column 24 solely as a result of the gradient.

The invention claimed is:

1. A method for cryogenic separation of air in a distillation column system for nitrogen/oxygen separation that comprises a first high-pressure column (23), a low-pressure column (25, 26), a second high-pressure column (24), a high-pressure column overhead condenser (27), a low-pressure column bottoms evaporator (28), and an auxiliary condenser (29; 228), said method comprising:

cooling a first feed air stream in a main heat exchanger (20, 21), introducing the cooled first feed air stream (22) at a first pressure into the first high-pressure column (23), condensing gaseous overhead nitrogen (44, 45) from the first high-pressure column (23) in the high-pressure column overhead condenser (27), introducing at least one portion (47) of the overhead nitrogen (46) condensed in the high-pressure column overhead condenser (27) into the first high-pressure column (23) as reflux liquid, evaporating one portion of bottoms liquid (66) of the low-pressure column (25, 26) in the low-pressure column bottoms evaporator (28) by indirect heat exchange with a condensing heating fluid (58), removing an unevaporated portion (67) of the bottoms liquid (66) from the low-pressure column (25, 26), and at least partly evaporating said unevaporated portion (67) of the bottoms liquid (66) of the low-pressure column (25, 26) in the auxiliary condenser (29; 228), wherein said the auxiliary condenser (29; 228) is separate from said low-pressure column (25, 26), and removing as a gaseous oxygen product (69) at least one portion of the liquid (68) evaporated in the auxiliary condenser (29; 228)

cooling a second feed air stream in the main heat exchanger (20, 21), introducing the cooled second feed air stream (35) into the second high-pressure column (24) at a second pressure, which is higher than the first pressure, and using at least one portion of overhead gas (58) from the second high-pressure column (24) as said condensing heating fluid in the low-pressure column bottoms evaporator (28), wherein said unevaporated portion (67) of the bottoms liquid (66) of the low-pressure column (25, 26) is at least partly evaporated in the auxiliary condenser (29; 228) by indirect heat exchange with a third air feed stream (36), and said third air feed stream is at least partially condensed by said indirect heat exchange with evaporating bottoms liquid (66) of the low-pressure column (25, 26).

2. The method as claimed in claim 1, wherein a nitrogen-enriched stream (51, 52) from said first high-pressure column (23) or said second high-pressure column (24) is work-producingly expanded (53), and the resultant work-producingly expanded, nitrogen-enriched stream (54) is warmed in the main heat exchanger (20, 21).

3. The method as claimed in claim 1, wherein the high-pressure column overhead condenser (27) is operated as a low-pressure column intermediate evaporator (27) by evaporating therein a liquid intermediate fraction (75) from the low-pressure column (25, 26) and passing (77, 79) at least one portion of the evaporated intermediate fraction from the low-pressure column intermediate evaporator (27) as ascending gas into the low-pressure column (25, 26).

4. The method as claimed in claim 1, wherein the low-pressure column is formed by at least a first section (25) and a second section (26), said first section (25) and said second section (26) being arranged in separate containers, wherein each container comprises mass transfer elements, and said second section (26) of said low-pressure column is arranged alongside said first high-pressure column (23).

5. The method as claimed in claim 4, wherein the first section (25) of the low-pressure column comprises the mass transfer elements between low-pressure column intermediate evaporator (27) and low-pressure column bottoms evaporator (28), and the second section (26) comprises the mass transfer elements at the top of the low-pressure column.

6. The method as claimed in claim 5, wherein said first section (25) of the low-pressure column is arranged alongside the first high-pressure column (23).

7. The method as claimed in claim 5, wherein the first section (25) of the low-pressure column is arranged over the first high-pressure column (23).

8. The method as claimed in claim 4, wherein the high-pressure column overhead condenser (27) is arranged above or within the first section (25) of the low-pressure column.

9. The method as claimed in claim 4, wherein the low-pressure column bottoms evaporator (28) is arranged below or within the first section (25) of the low-pressure column.

10. The method as claimed in claim 1, wherein the auxiliary condenser (29; 228) is arranged below the low-pressure column bottoms evaporator (28).

11. The method as claimed in claim 1, wherein the first high-pressure column (23) is arranged below the second high-pressure column (24).

12. The method as claimed in claim 11, wherein the auxiliary condenser (29) is arranged between the first and second high-pressure columns.

13. The method as claimed in claim 1, wherein, prior to the at least partially condensing in the auxiliary condenser (29), said third feed air stream is cooled in the main heat exchanger (20, 21).

14. The method as claimed in claim 1, wherein a total air feed stream (1) is compressed to a first total air pressure, which is higher than the first pressure but lower than the second pressure, the total air feed stream (5, 9) at the first total air pressure is divided into a first air substream (10) and a second air substream (11), the first air feed substream (10, 19) at approximately the first total air pressure is introduced into the main heat exchanger (20, 21) where said first air feed substream is cooled, the first feed air stream (22) for the first high-pressure column (23) is formed by at least one portion of the cooled first air substream, the second air substream (11) is boosted (12) to a pressure which is higher than the first total air pressure, the boosted second air substream (14, 17, 33) is passed into the main heat exchanger (20, 21), where said boosted second air substream is cooled to produce a cooled boosted second air substream (34), and the second feed air stream (35) for the second high-pressure column (24) is formed by at least one portion of said cooled boosted second air substream (34).

15. The method as claimed in claim 14, wherein the third feed air stream (36) for the auxiliary condenser (29) is formed by at least one portion of said cooled boosted second air substream (34).

16. The method as claimed in claim 1, wherein a fourth feed air stream (151, 152) is work-producingly expanded (153) and passed (154) into the low-pressure column (25, 26).

17. The method as claimed in claim 1, wherein the auxiliary condenser (29) is a bath evaporator.

18. The method as claimed in claim 1, wherein the high-pressure column overhead condenser (27) and the low-pressure column bottoms evaporator (28) are bath evaporators.

19. The method as claimed in claim 1, wherein the low-pressure column bottoms evaporator (28) is arranged at the top of the second high-pressure column (24).

20. The method as claimed in claim 1, wherein the high-pressure column overhead condenser (27) and/or the low-pressure column bottoms evaporator (28) are falling film evaporators.

21. The method as claimed in claim 2, wherein at least one portion of the warmed, nitrogen-enriched stream (55) is used as regenerating gas (56, 57) in a purification device (18, 30; 118) for feed air.

22. The method as claimed in claim 6, wherein said first section (25) of the low-pressure column is arranged between the first high-pressure column (23) and second section (26) of the low-pressure column.

23. The method as claimed in claim 13, wherein the third feed air stream (36) when introduced into the auxiliary condenser (29) is at a third pressure which is higher than the first pressure.

24. The method as claimed in claim 23, wherein the third pressure is equal to the second pressure.

25. The method as claimed in claim 1, wherein a nitrogen-enriched stream (51, 52) from said first high-pressure column (23) is work-producingly expanded (53), and the resultant work-producingly expanded, nitrogen-enriched stream (54) is warmed in the main heat exchanger (20, 21).

26. The method as claimed in claim 1, wherein the at least partly condensed third feed air stream (37) from said auxiliary condenser (29) is introduced into a phase separator (38), a first portion (40) of the liquid fraction (39) from said phase separator (38) is introduced into said first high-pressure column (23), and a second portion (41) of the liquid fraction (39) from said phase separator (38) is introduced into said low-pressure column (26).

27. The method according to claim 1, wherein a first portion (60) of the condensed heating fluid (59) from said low-pressure column bottoms evaporator (28) is introduced into the top of the second high-pressure column (24) of as reflux, and a second portion (61) of the condensed heating fluid (58) from said low-pressure column bottoms evaporator (28) is cooled in a subcooling countercurrent heat exchanger (42) and introduced into the top of said low-pressure column (26) as reflux.

28. The method according to claim 1, wherein at least a portion of the third air feed stream condensed in the auxiliary condenser is introduced into the first high-pressure column.

29. The method according to claim 1, wherein at least a portion of the third air feed stream condensed in the auxiliary condenser is introduced into the low-pressure column.

30. The method according to claim 1, wherein a portion of the third air feed stream condensed in the auxiliary condenser is introduced into the first high-pressure column, and another portion of the third air feed stream condensed in the auxiliary condenser is introduced into the low-pressure column.

* * * * *